US007258581B2

(12) United States Patent
Wan et al.

(10) Patent No.: US 7,258,581 B2
(45) Date of Patent: Aug. 21, 2007

(54) MODULAR JACK CONNECTOR AND METHOD OF MAKING THE SAME

(75) Inventors: Qin Wan, Kunshan (CN); Liang Chen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 35 days.

(21) Appl. No.: 11/168,606

(22) Filed: Jun. 27, 2005

(65) Prior Publication Data

US 2006/0128228 A1 Jun. 15, 2006

(30) Foreign Application Priority Data

Dec. 10, 2004 (CN) ..... 2004 2 0054279

(51) Int. Cl.
*H01R 24/00* (2006.01)

(52) U.S. Cl. ..... 439/676; 439/941

(58) Field of Classification Search ..... 439/676, 439/941

See application file for complete search history.

(56) References Cited

U.S. PATENT DOCUMENTS

| | | | | |
|---|---|---|---|---|
| 5,425,660 | A * | 6/1995 | Weikle | 439/676 |
| 5,456,619 | A | 10/1995 | Belopolsky et al. | |
| 5,749,752 | A * | 5/1998 | Kashiyama et al. | 439/733.1 |
| 6,431,917 | B1 * | 8/2002 | Belopolsky et al. | 439/676 |
| 6,447,341 | B1 * | 9/2002 | Hyland | 439/676 |

* cited by examiner

*Primary Examiner*—Xuong Chung-Trans
(74) *Attorney, Agent, or Firm*—Wei Te Chung

(57) ABSTRACT

A modular jack (100) includes an insulative housing (20) having a base wall (22) and a peripheral lateral wall (26) projecting in generally normal relation from the base wall to define an interior cavity (30), a number of conductive contacts (40) fastened to the outer side of the lateral wall and extending into the interior cavity, and an insulative spacer (60) installed in the interior cavity for positioning the contacts therein.

5 Claims, 6 Drawing Sheets

MODULAR JACK CONNECTOR AND METHOD OF MAKING THE SAME

BACKGROUND OF THE INVENTION

1. Field of the Invention

The present invention relates to a modular jack connector, and more particularly, to a modular jack connector having an insulative spacer arranged in the connector for positioning the contacts therein.

2. Description of the Prior Art

A conventional modular jack connector, disclosed in U.S. Pat. No. 5,456,619 issued to Belopolsky et al. on Oct. 10, 1995, includes an insulative housing having a base wall and a peripheral lateral wall projecting in generally normal relation from the base wall to define an interior cavity. A contact module is fixed to the housing from the bottom side. The contact module includes a plurality of conductive contacts having arms extending in the interior cavity from the lateral wall slantwise towards the base wall. Each of the arms has a free end extending into corresponding slot defined in the base wall. The free end abuts the bottom wall in the slot in case that the arms of the contacts are brought out when a plug mated in the modular jack is unmated. For the complicated structure of the contact module, it is difficult and time-consuming to manufacture the modular jack connector.

U.S. Pat. No. 6,431,917 issued to Belopolsky et al. on Aug. 13, 2002 disclosed another modular jack similar to the modular jack as disclosed in U.S. Pat. No. 5,456,619, except that the contacts are directly fastened to the outer side of the peripheral lateral wall. When the contacts are installed into the housing, the contacts are bent and move along the length direction of contacts at the same time. This complicated operation makes it difficult to control the mating lengths of the arms of the contacts engaging with the base wall, so that some of the arms of the contacts are easily brought out when a plug mated in the modular jack is unmated.

Hence, an improved modular jack is needed to solve the above problems.

BRIEF SUMMARY OF THE INVENTION

The present invention is a modular jack including an insulative housing, a plurality of conductive contacts, and an insulative spacer. The insulative housing forming a base wall adapted to be mounted on a PCB and a peripheral wall in generally normal relation from the base wall to define an interior cavity adapted for a mating plug to be inserted therein. The peripheral wall comprises a mounting wall. The mounting wall defines an inner side facing the interior cavity and an opposite outer side. The contacts fastened to the outer side of the mounting wall. Each of the contacts includes a bend portion extending from the outer side of the mounting wall to the inner side, a diagonal contact portion connecting with the bend portion and extending diagonally a free end towards the base wall. The spacer is installed in said cavity for engaging with the free end of the diagonal contact portion.

A main object of the present invention is to provide a modular jack having a plurality of contacts fastened conveniently to the housing and having a simple contact positioning means adapted to keep the contacts in position solidly when a plug mated in the modular jack is unmated.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
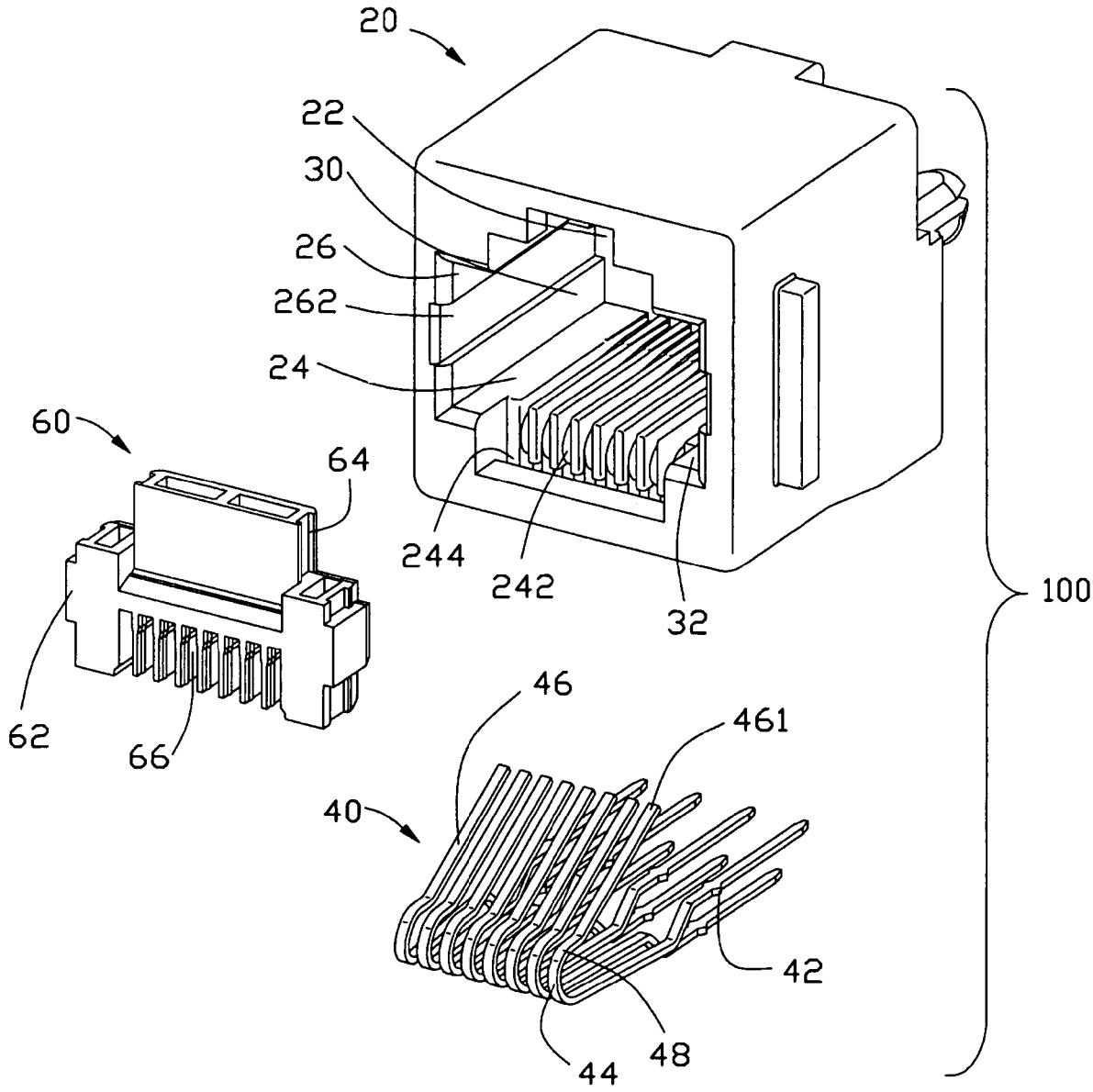
FIG. 1 is an exploded view of a modular jack of the present invention.

Reference will now be made to the drawing figures to describe the present invention in detail.

Referring to FIG. 1, a modular jack 100 includes an insulative housing 20, a plurality of conductive contacts 40 fastened to the housing 20, and an insulative spacer 60 arranged in the modular jack 100 for positioning the contacts 40 therein.

Figure 2:
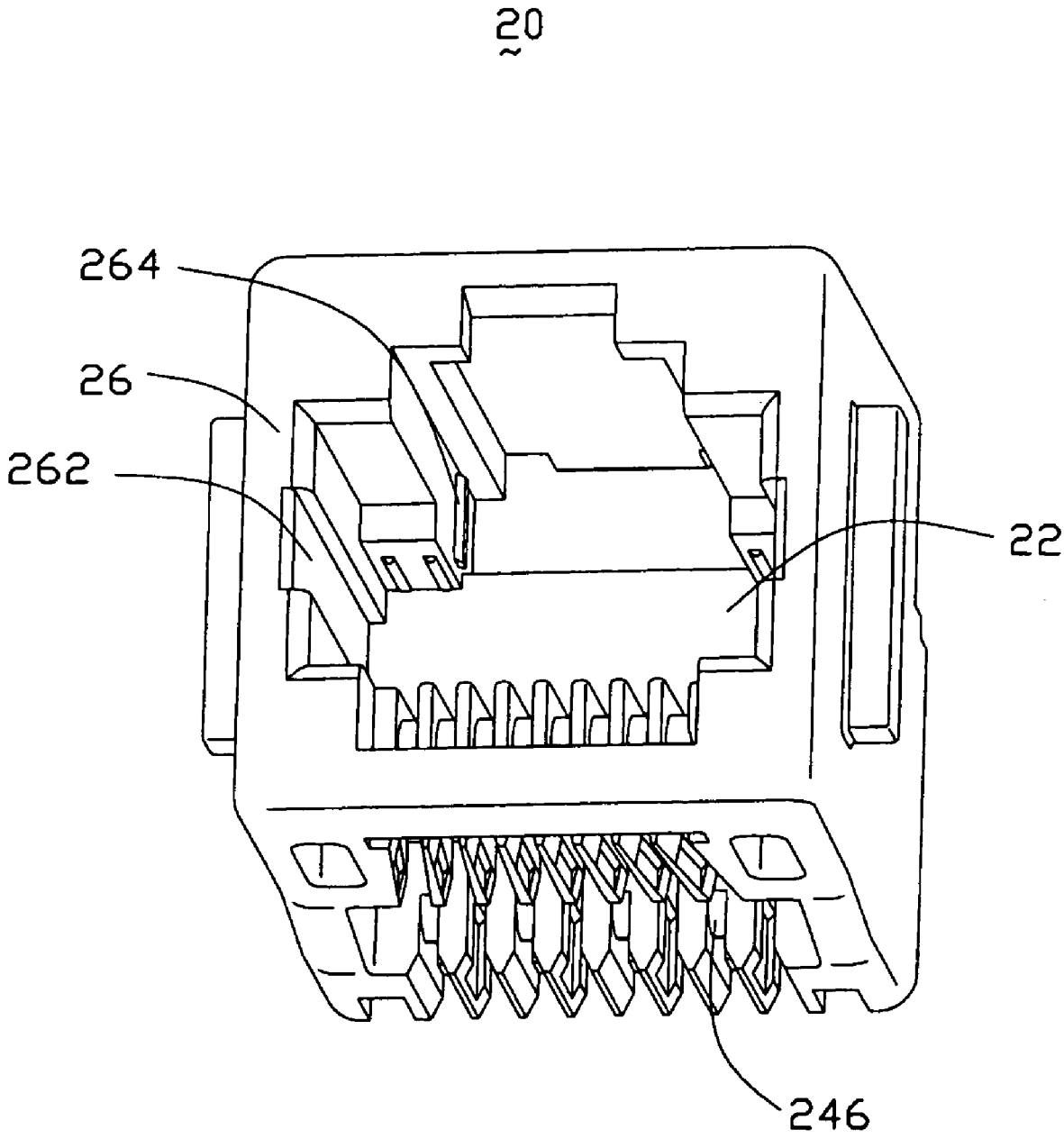
FIG. 2 is a perspective view of an insulative housing of the modular jack shown in FIG. 1.
Figure 5:
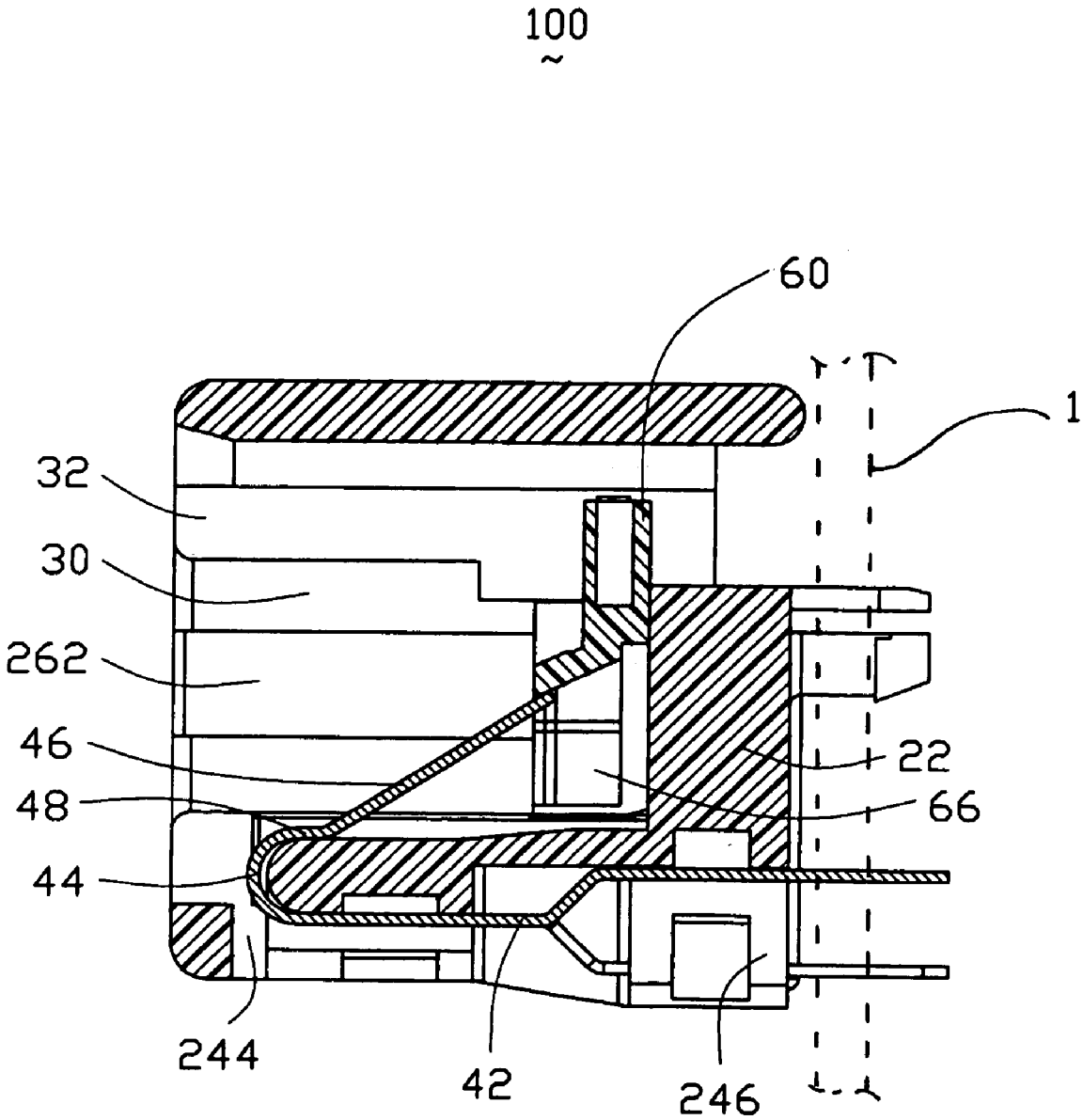
FIG. 5 is a sectional view of the modular jack taken along line 5—5 in FIG. 4.

Referring to FIGS. 1 and 2, the insulative housing 20 includes a base wall 22 adapted to be mounted on a PCB 1 (FIG. 5) and a peripheral lateral wall 26 perpendicularly extending from the base wall 22 to define an interior cavity 30. The cavity 30 is used to receive a plug (not shown) and has an inserting open 32 opposite the base wall 22. The peripheral lateral wall 26 includes a mounting wall 24, a top wall opposite to the mounting wall 24, and a pair of sidewalls connecting the mounting wall 24 and the top wall. The mounting wall 24 is. The outer side of the mounting wall 24 defines a corresponding number of fastening slots 246 for fastening the contacts 40 therein and a hole 244 for the contacts 40 to get there through. The hole 244 is disposed near the inserting open 32 and defined with a plurality of contact grooves 242 for positioning the contacts 40. The inner sides of the opposite sidewalls adjacent to the mounting wall 24 extend a pair of guiding grooves 262 and protrude a pair of bulges 264. The guiding grooves 262 extend to the inserting open 32 adapted to guide the spacer 60 into the cavity 30. The bulges 264 are located close to the base wall 22 for engaging with the spacer 60 and keeping the spacer 60 there.

The contact 40 is shaped in a long metal strip and forms a soldering portion (not labeled) at one end adapting to solder with the PCB which the modular jack is mounted on, a fastening portion 42 connecting the soldering portion and engaging in the corresponding fastening slot 246, a bend portion 44 bent around part of the mounting wall 24 and received in the contact grooves 242, a straight portion 48 extending along and abutting the inner side of the mounting wall 24, a diagonal contact portion 46 extending slantwise towards the base wall 22. The diagonal contact portion 46 further forms a free end 461 for engaging with the spacer 60. When the plug is inserted into the cavity 30, the diagonal contact portion 46 contacts corresponding terminal arranged in the plug.

Figure 3:
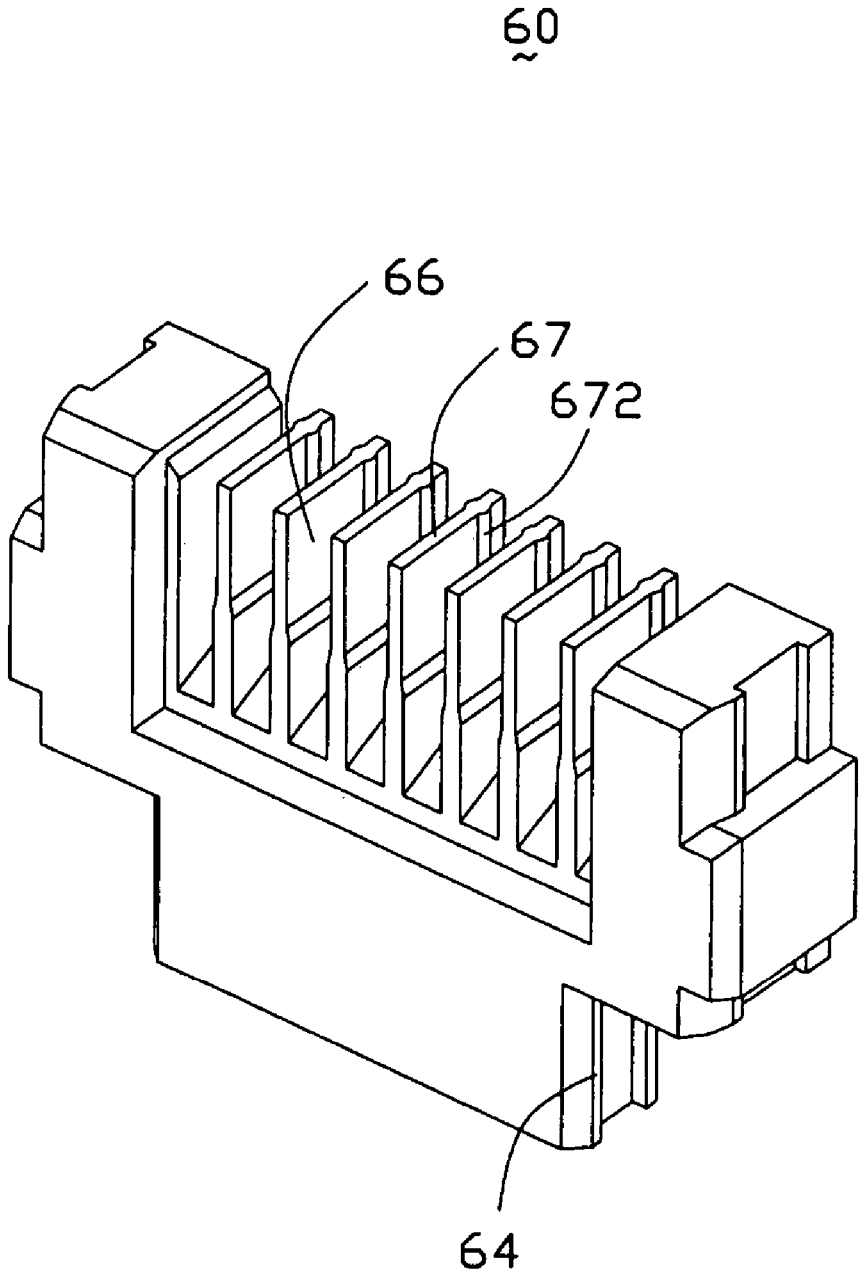
FIG. 3 is a perspective view of an insulative spacer of the modular jack shown in FIG. 1.
Figure 4:
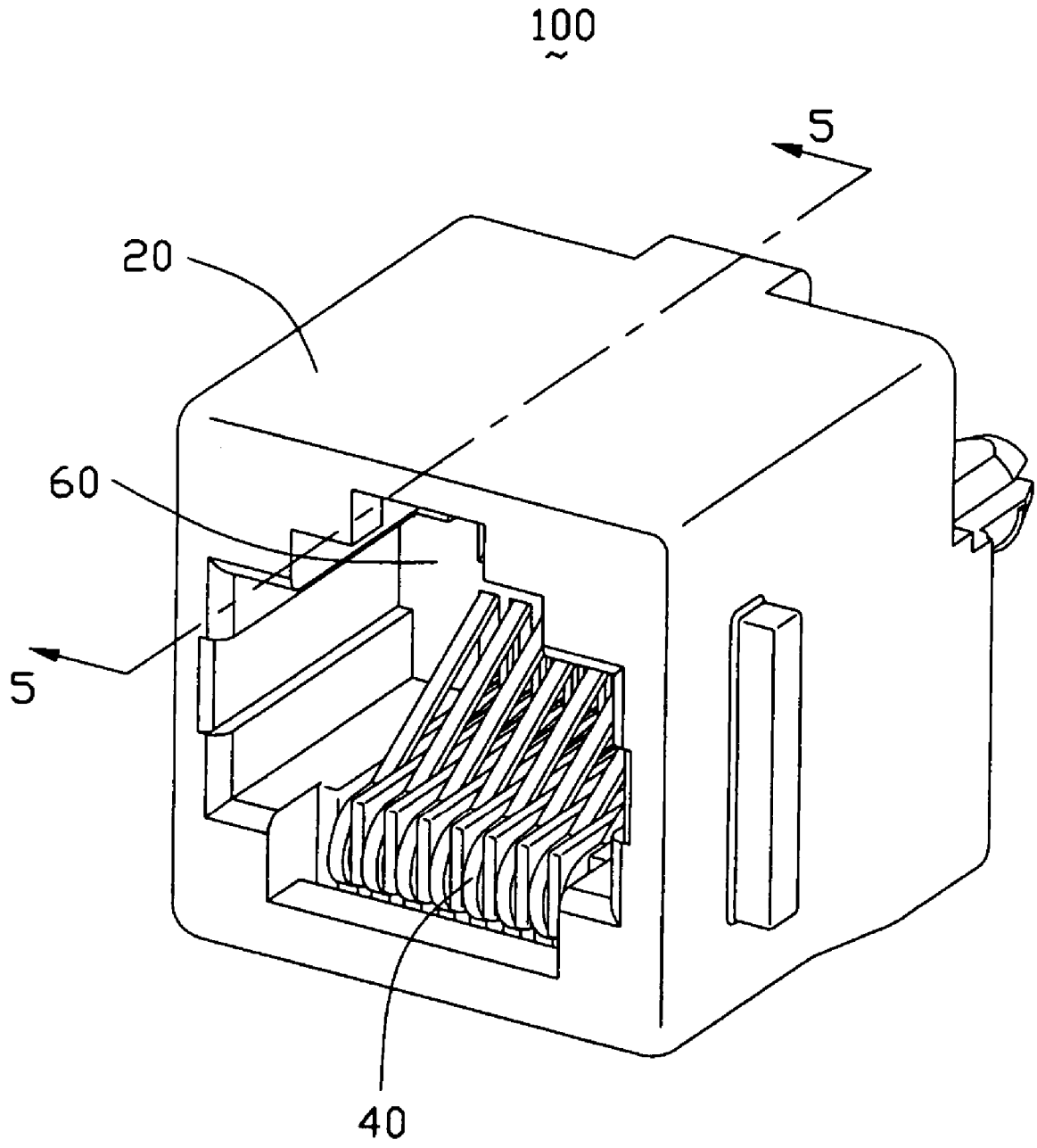
FIG. 4 is an assembled view of the modular jack shown in FIG. 1.

Reference to FIGS. 1 and 3, the spacer 60 forms a plurality of separative walls parallel to each other to define a plurality of slots 66 for receiving the free end 461 of the diagonal contact portion 46. When the mating plug is pulled out from the modular jack 100 and tend to bring out the diagonal contact portion 46 of the contact 40, the spacer 60 will abut the free end 461 of the diagonal contact portion 46 and keep it in position. The spacer 60 forms a pair of guiding portions 62 and a pair of protruding blocks 64 at two opposite ends. The guiding portions 62 mate with corresponding guiding grooves 262 when the spacer 60 is inserted into the interior cavity 30 of the housing 20. When the spacer 60 reaches the base wall 22 in the interior cavity 30, the blocks 64 engage corresponding bulges 264 to prevent the spacer 60 from getting out easily. Further more, each separative wall 67 forms a rib 672 extending along the opening direction of slot 66 for precisely positioning the diagonal contact portion 46.

Figure 6:
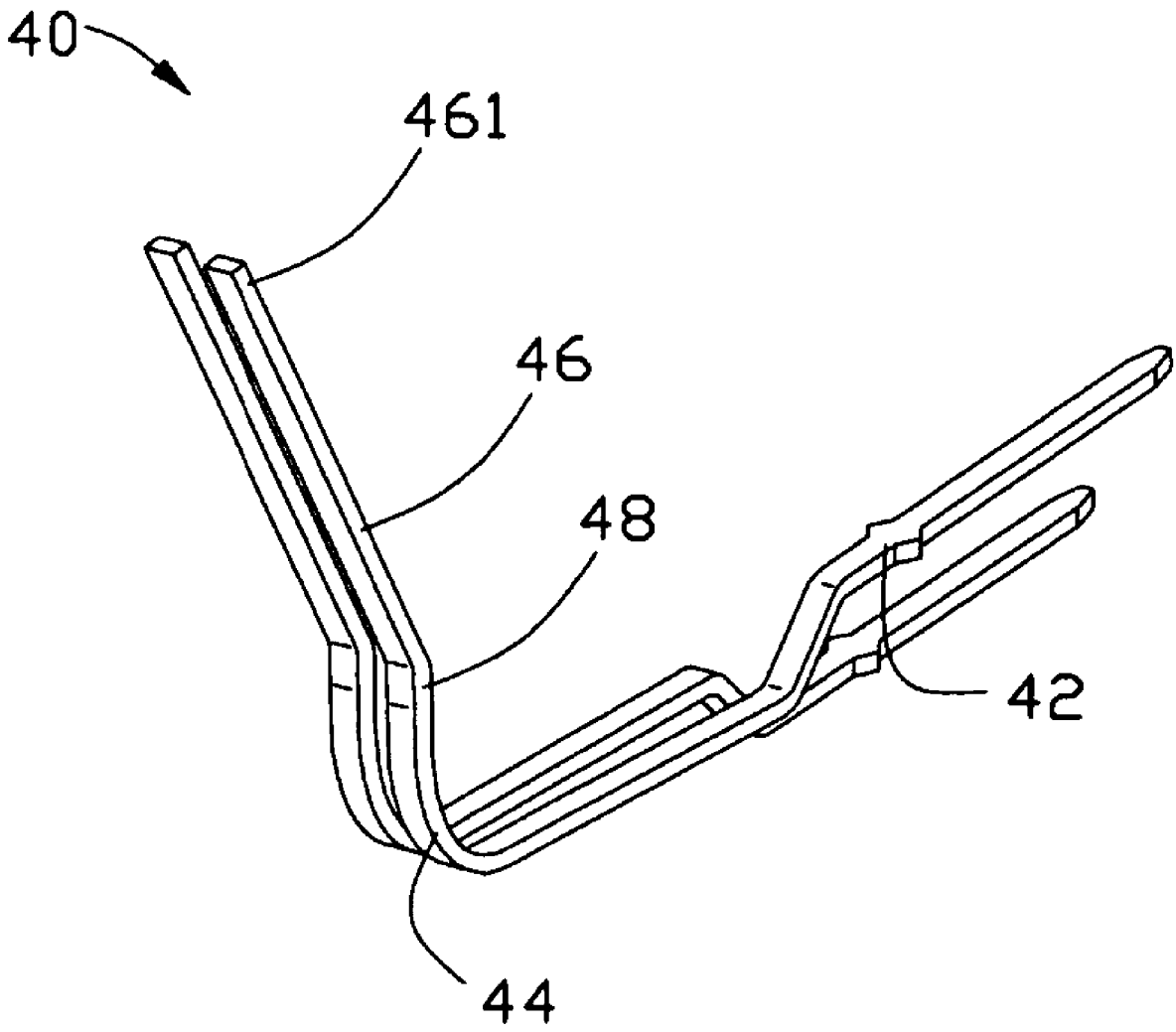
FIG. 6 is a pair of conductive contacts before being installed into the housing.

Reference to FIG. 1, 4, 5 and 6, in accord with the preferred method of making the modular jack 100, before the contacts 40 are mounted in the housing 20, the bend portion 44 are not completely bent, but are bent as described in FIG. 6. Then, the contacts 40 are partly inserted into the housing with the diagonal contact portions 46 disposed in the interior cavity 30 and the bend portion 44 in the contact grooves 242. Thirdly, the fastening portions 42 are pressed into the fastening slots 246 and interferentially mate with the housing 20 therein. Fourthly, the contacts 40 are further bent into the shape as described in FIG. 1. Then, the straight portion 48 abuts the inner side of the mounting wall 24. Finally, the spacer 60 is inserted into the cavity 30 to the final position where the free ends 461 of the diagonal contact portions 46 received in corresponding slots 66.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A modular jack comprising:

an insulative housing forming a base: wall and a peripheral wall in generally normal relation to said base wall to define an interior cavity for receiving a mating plug, said peripheral wall comprising a mounting wall, said mounting wall defining an inner side facing said cavity and an outer side facing opposite;

a plurality of conductive contacts fastened to the outer side of the mounting wall, each of said contacts forming a bend portion extending from said outer side of the mounting wall to the inner side, and a diagonal contact portion connecting with the bend portion and extending slantwise towards base wall, the diagonal contact portion further forming a free end; and a discrete insulative spacer installed in said cavity and secured therein, said spacer engaging with the free ends of the diagonal contact portion; wherein said peripheral wall further comprises a pair of opposite sidewalls adjacent to said mounting wall, each of sidewalls defining an inner side facing said cavity, said inner side defining a guiding groove, and wherein said spacer is an integrally molded insulator and forms a guiding portion for engaging in corresponding guiding groove; and wherein either of said sidewalls protrudes a bulge on the inner side, and said spacer forming a block corresponding to said bulge, said block engaging said bulge for keeping the spacer in position when the spacer is installed in said cavity.

2. The modular jack according to claim 1, wherein each of said contacts forms a straight portion connecting said diagonal contact portion to said bend portion and abutting the inner side of said mounting wall.

3. The modular jack according to claim 1, wherein said mounting wall defines a hole, said bend portion getting through said hole in the mounting wall.

4. The modular jack according to claim 1, wherein said spacer defines a corresponding number of slots, and said free ends of the diagonal contact portions engage in corresponding slots.

5. The modular jack according to claim 4, wherein said spacer forms a plurality of separative walls which define said slots, said separative walls forming ribs intercrossing said diagonal contact portion in said slots for precisely positioning the free end of the diagonal contact portion.

* * * * *